US006220462B1

(12) United States Patent
Brockman et al.

(10) Patent No.: US 6,220,462 B1
(45) **Date of Patent: *Apr. 24, 2001**

(54) FLEXIBLE PARTS TRANSPORTING SYSTEM

(75) Inventors: Bruce F. Brockman, North Ridgeville, OH (US); Joseph P. Wieczorek, Madison Heights, MI (US)

(73) Assignee: Irvin Automotive Products, Inc., Auburn Hills, MI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/994,467

(22) Filed: Dec. 19, 1997

(51) Int. Cl.[7] ..... A47B 43/00

(52) U.S. Cl. ..... 211/131.1; 206/583; 211/186; 211/126.2; 211/191; 211/195; 108/902

(58) Field of Search ..... 211/126.12, 126.2, 211/131.1, 194, 186, 189, 191, 188, 150, 165, 195; 206/386, 595, 583, 508, 503, 511, 513; 108/99, 91, 166, 179, 115–117, 901–902; 220/4.26, 23.6

(56) References Cited

U.S. PATENT DOCUMENTS

| | | | | |
|---|---|---|---|---|
| 793,451 | * | 6/1905 | Lindsay et al. | 211/150 |
| 1,742,738 | * | 1/1930 | Turner | 211/126.2 |
| 1,820,497 | * | 8/1931 | Rose | 211/126.2 |
| 1,856,935 | * | 5/1932 | Turner | 211/182 |
| 1,919,879 | * | 7/1933 | Einson et al. | 206/583 |
| 2,877,602 | * | 3/1959 | Larsen | 211/186 |
| 2,963,248 | * | 12/1960 | Anderson | 108/2 |
| 3,319,799 | * | 5/1967 | Paxton | 211/126.2 |
| 3,498,471 | * | 3/1970 | Dirxx | 211/131.1 |
| 3,503,519 | * | 3/1970 | Jay | 211/194 |
| 3,519,140 | * | 7/1970 | Wellman, Jr. | 211/186 |
| 3,762,572 | * | 10/1973 | Hager | 211/150 |
| 3,981,511 | * | 9/1976 | Foster | 211/150 |
| 4,052,084 | * | 10/1977 | Propst | 211/126.2 |
| 4,512,591 | * | 4/1985 | Plante | 211/186 |
| 4,529,092 | * | 7/1985 | Swingley, Jr. | 206/583 |

(List continued on next page.)

OTHER PUBLICATIONS

Arlington Rack and Packaging Company, Steering Wheel Rack, unknown, 1.

Arlington Rack and Packaging Company, Custom Racks, unknown, 1.

Arlington Rack and Packaging Company, Interior Door Panel and Trim Specialists, unknown, 1.

Arlington Rack and Packaging Company, Collapsible Racks and Containers, unknown, 1.

*Primary Examiner*—Daniel P. Stodola
*Assistant Examiner*—Jennifer E. Novosad
(74) *Attorney, Agent, or Firm*—Dinnin & Dunn, P.C.

(57) ABSTRACT

A parts transporting system including a rigid rack frame, a plurality of uprights coupled to the rigid rack frame, a plurality of shelf supports coupled to the uprights, and a plurality of shelf assemblies operably coupled to the uprights and the shelf supports. Each shelf assembly is constructed of a shelf frame and an offset pivot hinge operably coupled to the shelf frame and the shelf support, allowing the shelf frame to swing open at an angle with respect to the rigid rack frame. A lid and strut assembly is operably coupled to each of the shelf frames and includes a lid, a seal covering the entire perimeter of the lid and providing a dirt and moisture resistant seal, and a strut coupled to the lid. Each shelf frame is coupled to a sling assembly which forms compartments used to hold parts. Each shelf frame is positioned directly above each lid except the top lid. When each of the shelf assemblies is emptied, it is lifted, and this action lifts the lid below the shelf assembly, exposing the next layer of parts to be removed.

20 Claims, 8 Drawing Sheets

U.S. PATENT DOCUMENTS

| | | | | |
|---|---|---|---|---|
| 4,579,233 | * | 4/1986 | Hepp | 211/194 |
| 4,759,473 | * | 7/1988 | Derby et al. | 222/105 |
| 4,903,827 | * | 2/1990 | Phelps et al. | 206/583 |
| 4,946,036 | * | 8/1990 | Kupersmit | 206/583 |
| 4,971,234 | * | 11/1990 | Hay | 211/131.1 |
| 5,050,756 | | 9/1991 | Tielker et al. . | |
| 5,069,466 | * | 12/1991 | Propst | 211/186 |
| 5,211,290 | * | 5/1993 | Janus et al. | 206/583 |
| 5,267,663 | | 12/1993 | Dykhouse . | |
| 5,269,414 | * | 12/1993 | D'Hollander | 206/600 |
| 5,415,311 | * | 5/1995 | Coogan | 206/600 |
| 5,445,397 | * | 8/1995 | Evans | 206/505 |
| 5,452,811 | | 9/1995 | Taravella et al. . | |
| 5,465,988 | * | 11/1995 | Dennis | 280/47.35 |
| 5,533,643 | * | 7/1996 | Kruzick | 220/331 |
| 5,564,599 | * | 10/1996 | Barber et al. | 206/600 |
| 5,567,888 | * | 10/1996 | Boydle et al. | 73/863.86 |
| 5,601,198 | * | 2/1997 | Reed | 211/183 |
| 5,609,451 | * | 3/1997 | McCorkle, Jr. | 211/194 |
| 5,653,354 | * | 8/1997 | Olson | 206/595 |
| 5,692,625 | * | 12/1997 | Filipescu et al. | 211/194 |
| 5,699,925 | * | 12/1997 | Petruzzi | 206/508 |
| 5,725,119 | * | 3/1998 | Bradford et al. | 206/583 |

* cited by examiner

FLEXIBLE PARTS TRANSPORTING SYSTEM

BACKGROUND OF THE INVENTION

The present invention relates to a parts transporting system. More specifically the present invention relates to a modular flexible parts transporting system ideal for parts sequencing procedures involving varying part sizes.

It is frequently necessary to pack articles for shipment to a location where the articles are unpacked for assembly with other parts. An important aspect of a parts transporting system is its flexibility to accommodate parts of different sizes while still maintaining simple loading and unloading methods and a stackable shape. Various systems have been developed for parts storage and transportation which disclose a parts loading system using a compartmental scheme. These systems utilize moving rods and shelves to vary the size of their storage compartments. These systems are effective in maintaining a flexible configuration of the size and number of compartments. However, these systems do not utilize a sequenced, pivoting, multi-level, compartmentalized system which decreases the difficulty in loading and helps to protect parts. Loading and unloading these previous systems is done by placing each part in a compartment and then securing the part. The present invention reduces these two actions into one thereby reducing the time needed to load and unload parts. A system of lids and shelf assemblies are used in the present invention to protect, store, and secure parts. The lid and shelf assemblies are sequenced so that as each shelf assembly is emptied it is lifted and this action will lift the lid below, exposing the next layer of parts to be removed. The reverse action of loading is also sequenced so that as each shelf assembly is loaded the lid is closed, securing the loaded parts and opening the shelf assembly above. Another previous storage system discloses a two level storage layout which incorporates a pivoting upper deck that serves the dual purpose as a second level of storage and a lid for the bottom storage level. However, this system does not utilize a compartmentalized storage scheme that sequences, protects, and insures the cleanliness of the stored parts.

SUMMARY OF THE INVENTION

The present invention possesses shelf assemblies and a compartmental system that are easily modified into many different configurations to accommodate parts of differing size. The shelf assemblies are sequenced so that when parts are removed from each separate shelf assembly, that shelf assembly is raised to an elevated pivoted position, thus exposing parts in the next lower shelf assembly. An object of the present invention is to maintain simple loading and unloading methods no matter what configuration is chosen. By creating the sequenced shelf assemblies, the ease of loading and unloading parts from the system has been improved.

A further object of the invention is to maintain the safety and the cleanliness of the parts stored in the invention. Often parts are finely finished and require special handling to prevent marring or damage during transport. This invention protects such vulnerable parts by creating sealed flexible storage compartments.

Further objects, features, and advantages of the invention will become apparent from a consideration of the following description and the appended claims when taken in connection with the accompanying drawings.

DETAILED DESCRIPTION OF THE PREFERRED EMBODIMENT

Figure 1:
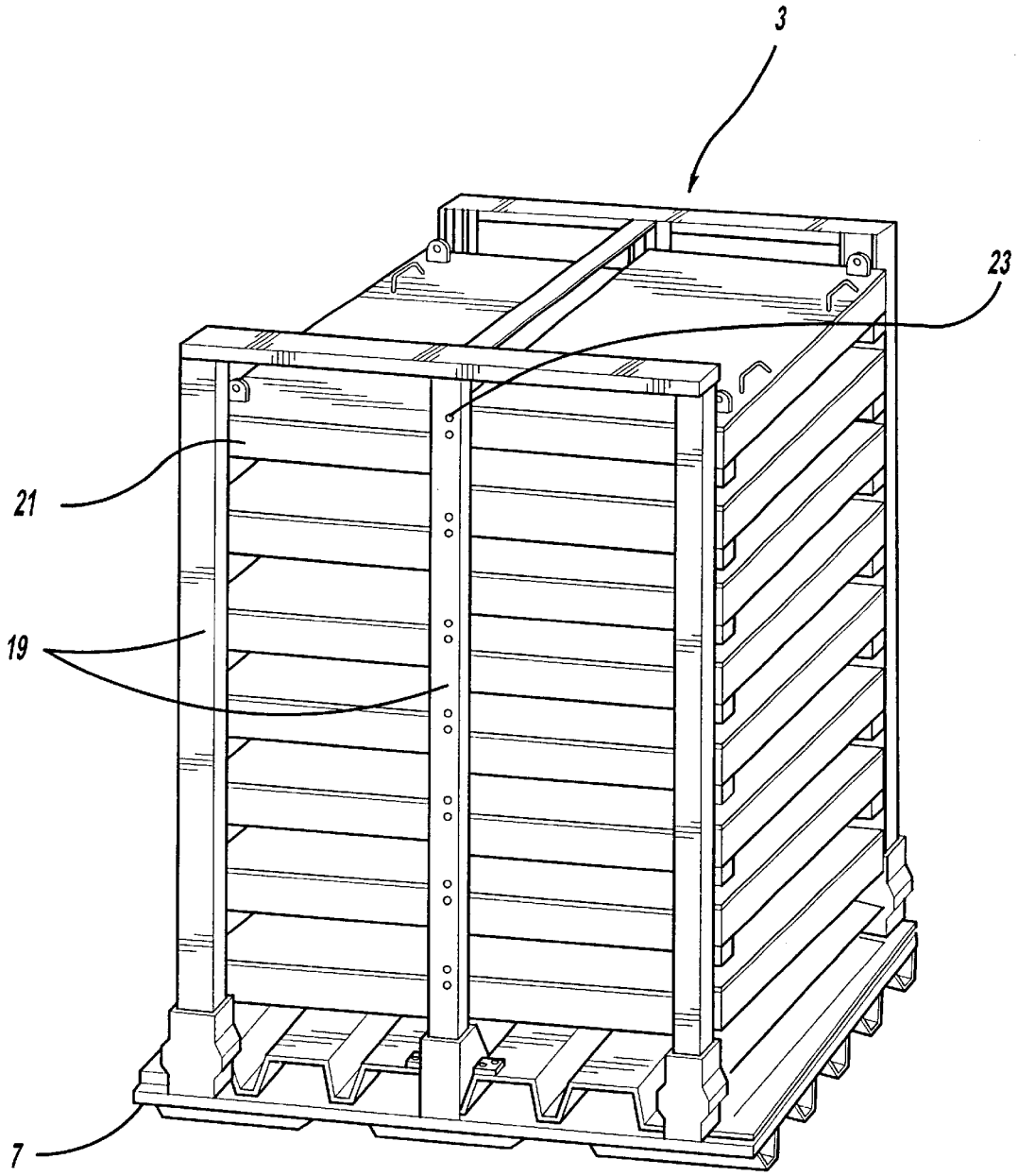
FIG. 1 is a perspective view of one embodiment of the present invention.

FIG. 1 is a perspective view of one embodiment of the present invention. The flexible parts transportation system is generally shown as 3 and is constructed from a rigid rack frame 7, uprights 19, and shelf assemblies 21. The uprights 19 are mounted on the rigid rack frame 7 and the shelf assemblies 21 are operably coupled to the uprights 19 by universal shelf supports 23.

Figure 2:
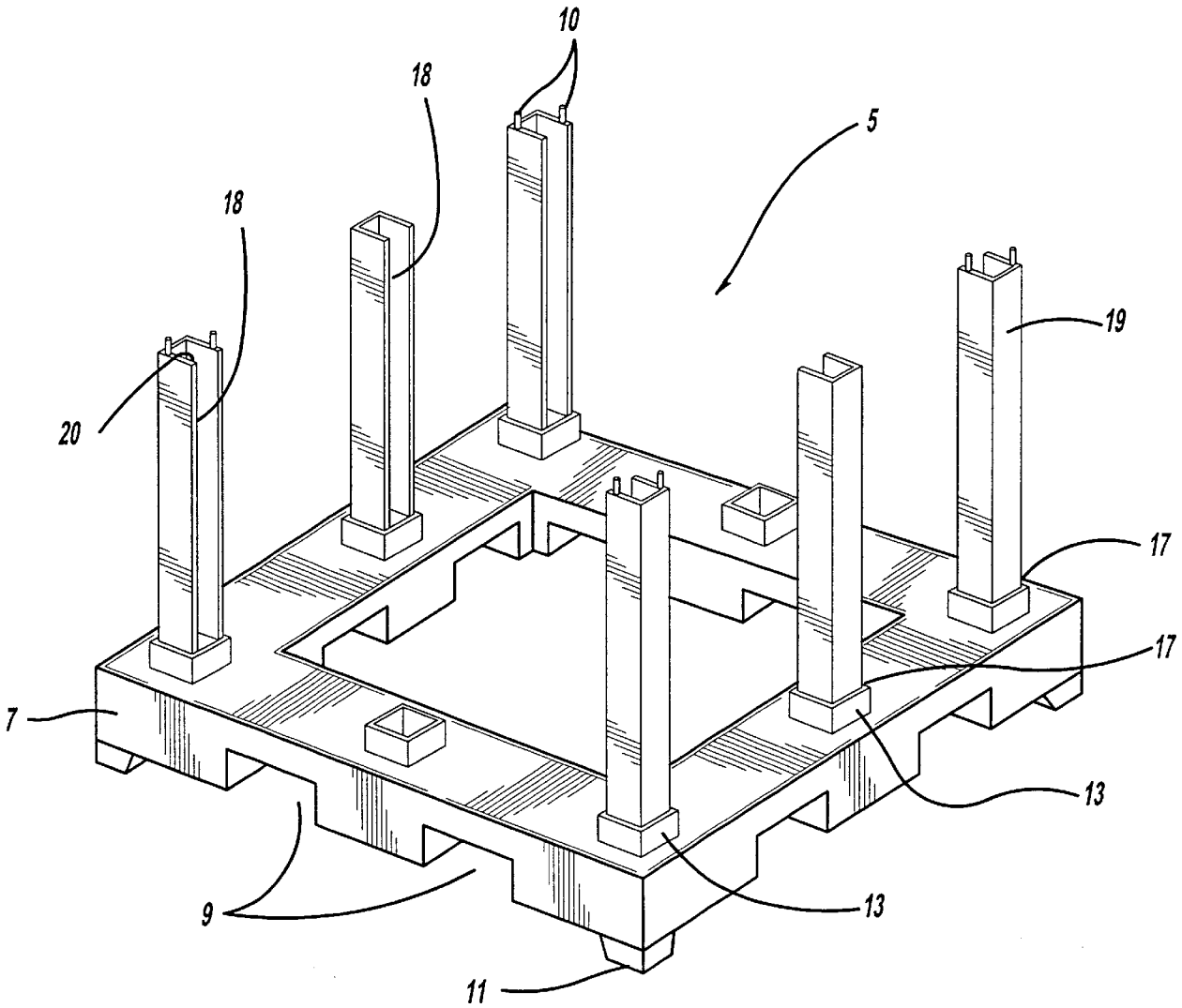
FIG. 2 is a perspective view of the framework of the flexible transportation system in accordance with one embodiment of the present invention.

FIG. 2 is a perspective view of the framework 5 of the flexible parts transportation system 3 in accordance with one embodiment of the present invention. The framework 5 has a rigid rack frame 7 which constitutes the base and determines the footprint of the flexible parts transporting system 3. The rigid rack frame 7 is generally rectangular in shape and formed in a segmented mold allowing flexible sizing and configuration. In one embodiment the mold comprises modular segments allowing any dimensional configuration of the rigid rack frame 7 which is a multiple of the segment size. The rigid rack frame 7 is preferably formed from sheet molded compound although other formable materials including plastics, metals, woods, and resins shaped by stamping, molding, carving or cutting can be used with equivalent results. The rigid rack frame 7 has recesses 9 for forklift entry and receptacles 11 for casters or stacking pins. The rigid rack frame 7 is designed so that the flexible parts transporting system 3 can be moved by an operator rolling it on installed casters, or lifting the system with a forklift, handjack or other movement means. In one embodiment of the present invention the receptacles 11 are cylindrical holes which will accept a caster mounted on a metal pin. In another embodiment the receptacles 11 may be used to accept pins 12 located on the topside of another flexible parts transporting system 3 (not shown). The penetration of these pins 12 into the receptacles 11 will insure a stable arrangement when multiple flexible parts transporting systems 3 are stacked for shipment.

The rigid rack frame 7 includes segments 13 whose edges define cavities 17. In one embodiment of the present invention there are eight segments 13 that are located at each comer of the rigid rack frame 7 and in the center of each side of the rigid rack frame 7. Uprights 19 are placed snugly into cavities 17 in a generally perpendicular manner with respect to the rigid rack frame 7 and are securely anchored by a fastening means. The uprights 19 add structural strength to allow for the stacking of several flexible parts transporting systems 3 and provide the basic vertical shape of the flexible parts transporting system 3. The uprights 19 of the preferred embodiment have a C shaped channel 18 running their entire length which provides a surface on which to mount additional components. In one embodiment the uprights 19 have an element 20 for securing the flexible parts transporting system 3 in a locked down position. The element 20 could be a metal loop affixed to uprights 19 for use with a portable lock or other suitable means.

Figure 3:
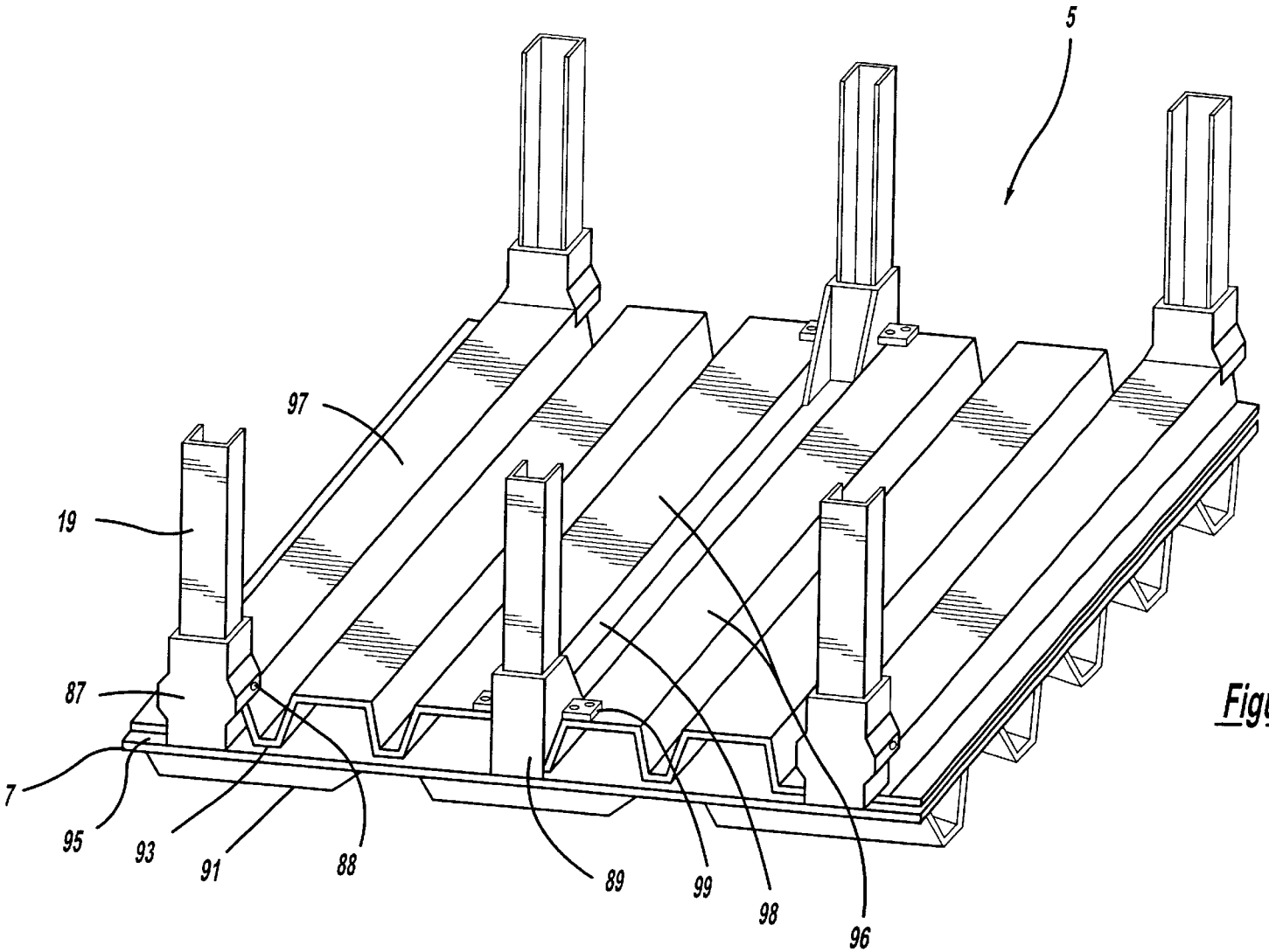
FIG. 3 is a perspective view of a second embodiment of the framework of the present invention.

FIG. 3 is a perspective view of a second embodiment of the framework 5 of the flexible transportation system 3. The rigid rack frame 7 is constructed from two sheets, 91 and 93, of corrugated sheet molded compound or suitable formable materials that have been shaped to the desired dimensions. The bottom corrugated sheet 91 is rotated ninety degrees with reference to the top corrugated sheet 93 so that the corrugations of sheets 91 and 93 are generally perpendicular to each other. The sheets 91 and 93 are then permanently coupled in this position to provide the basic structure of the rigid rack frame 7. Brackets 87 are then coupled to each corner of the rigid rack frame 7. In one embodiment sheet 93 has elevated corrugations 97 on its two ends and sheet 91 extends slightly outward from underneath sheet 93 in a direction parallel to the corrugations 97 of sheet 93 to create lips 95. Lips 95 extend slightly outward from the sides of the rigid rack frame 7 which are perpendicular to the corrugations 97. The brackets 87 are coupled directly onto the elevated corrugations 97 of the corrugated sheet 93 and rest on lips 95. In another embodiment the brackets 87 have flanges 88 that overlap the sides of the elevated corrugations 97 and are fastened to the elevated corrugations 97. Brackets 89 are coupled to the center of the sides of the rigid rack frame 7. In one embodiment sheet 93 has a depressed corrugation 98 in the center of its shortest side. Brackets 89 are coupled to the interior walls of the depressed corrugation 98 by flanges 99 that overlap the surface of the elevated corrugations 96 which adjoin the depressed corrugation 98. Uprights 19 are then coupled to the brackets 87 and 89.

Figure 4:
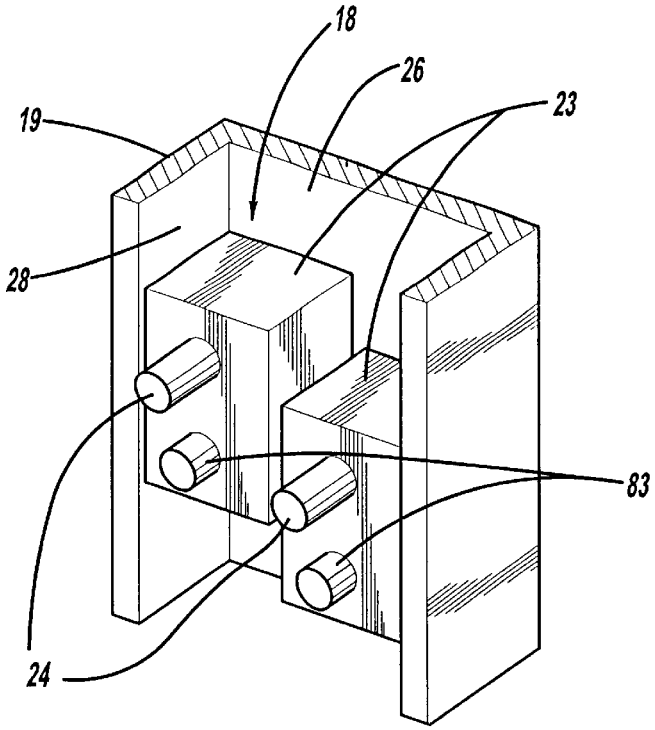
FIG. 4 is a perspective view of the universal shelf supports coupled to the uprights.

Selected uprights 19 coupled to the rigid rack frame 7 provide a mounting surface for the universal shelf supports 23 as shown in FIG. 4. Universal shelf supports 23 have spring loaded rods 83 and bolts 24 which couple to the offset pivot hinges 35 of later added shelf assemblies 21. In one embodiment the universal shelf supports 23 are attached to the root surface 26 within the C shaped channels 18 in uprights 19, but it would also be obvious to one skilled in the art to attach the supports 23 to the sides 528 of the channels 18. The uprights 19 which are equipped with shelf supports 23 will be determined by the shelf configuration of the flexible parts transporting system 3.

Figure 5:
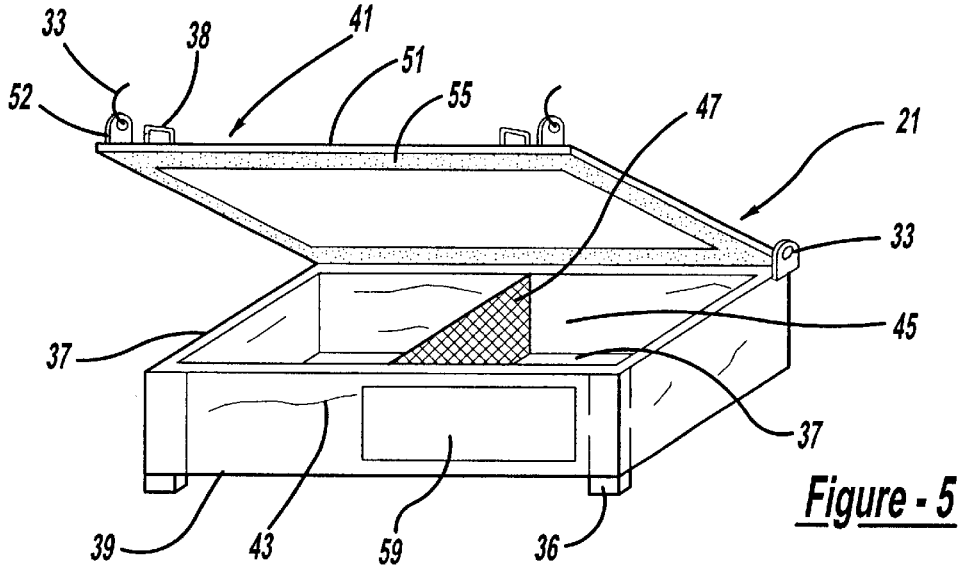
FIG. 5 is a perspective view of a shelf assembly with a single sling.

FIG. 5 is a perspective view of a shelf assembly 21 with a single open sling. Each shelf assembly 21 includes a shelf frame 37 and a sling assembly 39 which is chemically or mechanically connected to the shelf frame 37 and hangs downward from the shelf frame 37. The shelf frame 37 provides support and form for the sling assembly 39 and includes shelf frame supports 36 which rest on the shelf assembly 21 immediately below It. The shelf frame is also coupled to an offset pivot hinge 35 used to later mount the shelf assembly 21 to universal shelf supports 23. The sling assembly 39 is preferably made of a flexible material 43 to allow for shock absorption during transport. In one embodiment the flexible material 43 has a moistureproof coating to seal and protect the parts. Further materials can be used which protect the parts from dust or other contaminants commonly experienced during shipping and storage at manufacturing plants. Also, if the parts require air circulation during storage, a mesh can be used as the flexible material.

The sling assembly 39 can be configured into a single compartment 45 or multiple compartments. A permanent or removable dunnage 47 may be used to further subdivide the compartment 45 and provide a mechanical means to help secure parts. The sling assembly 39 may be coupled to the shelf frame 37 by mechanical or chemical means as mentioned above. In one embodiment the sling assembly 39 is attached to the shelf frame 37 on all exterior sides by a J clip. The J clip allows the removal of the sling in a fast and nondamaging manner.

A lid and strut assembly 41 is operably coupled to the shelf frame 37 and includes a lid 51, a lid attachment point 52, a linkage 53, and a strut anchor 38. In one embodiment the lid and strut assembly 41 is hinged to the shelf frame 37 to allow rotation of the lid and strut assembly 41 in an upward manner. The strut anchor 38 is an elevated bracket that is mounted onto the edge of the lid 51. When in the closed position the shelf frame support 36 of each shelf assembly 21 rests upon the strut anchor 38 immediately beneath it, providing a stable foundation. The lid 51 completely covers the sling assembly 39 during transport and storage. A seal 55 is affixed to the perimeter of the lid 51 providing a dirt and moisture seal. The sling assembly 39 in combination with the seal 55 provides a clean and safe method for the transport of fragile parts. In one embodiment of the present invention each compartment 45 of the sling assembly 39 may be equipped with a valve 57 to allow easy flushing of residue from each compartment 45. In another embodiment of the present invention the sling assembly 39 is equipped with a transparent window 59 or aperture so that stored parts may be viewed when the lid 51 is in a closed position.

Figure 6:
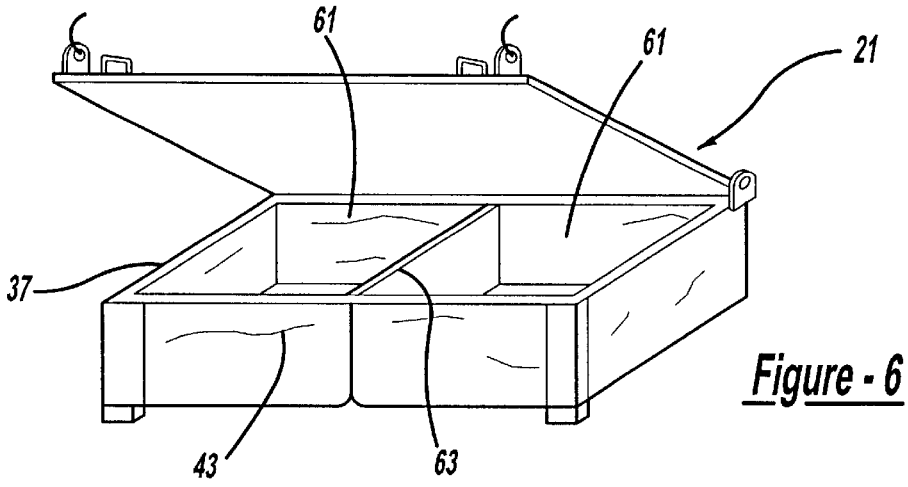
FIG. 6 is a perspective view of the shelf assembly with a twin sling.

FIG. 6 is a perspective view of the shelf assembly 21 with twin slings. This embodiment has subdivided the sling assembly 39 into two compartments 61 by the addition of a shelf sling support 63. In one embodiment the shelf sling support 63 is a rod that snaps into the center of the shelf frame 37. The compartments 61 are formed when the flexible material 43 of the sling assembly 39 is draped over the shelf sling support 63.

Figure 7:
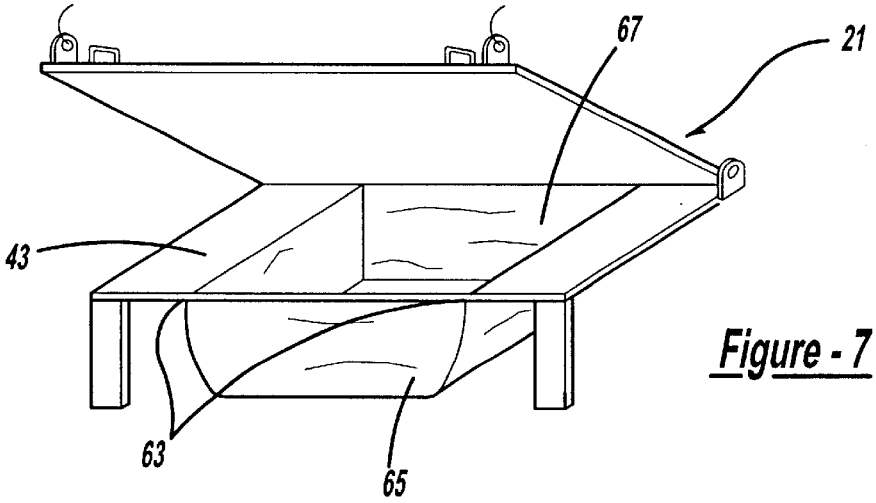
FIG. 7 is a perspective view of the shelf assembly with a center hung sling.

FIG. 7 is a perspective view of the shelf assembly 21 with a center hung sling 65. The flexible material 43 is pliant so that when the adjustable shelf sling supports 63 are slid in a perpendicular manner along the shelf support frame 37 the compartment 67 of the center hung sling 65 may be varied in size. Varying the compartment 67 size will allow a secure fit for parts of various sizes.

Figure 8:
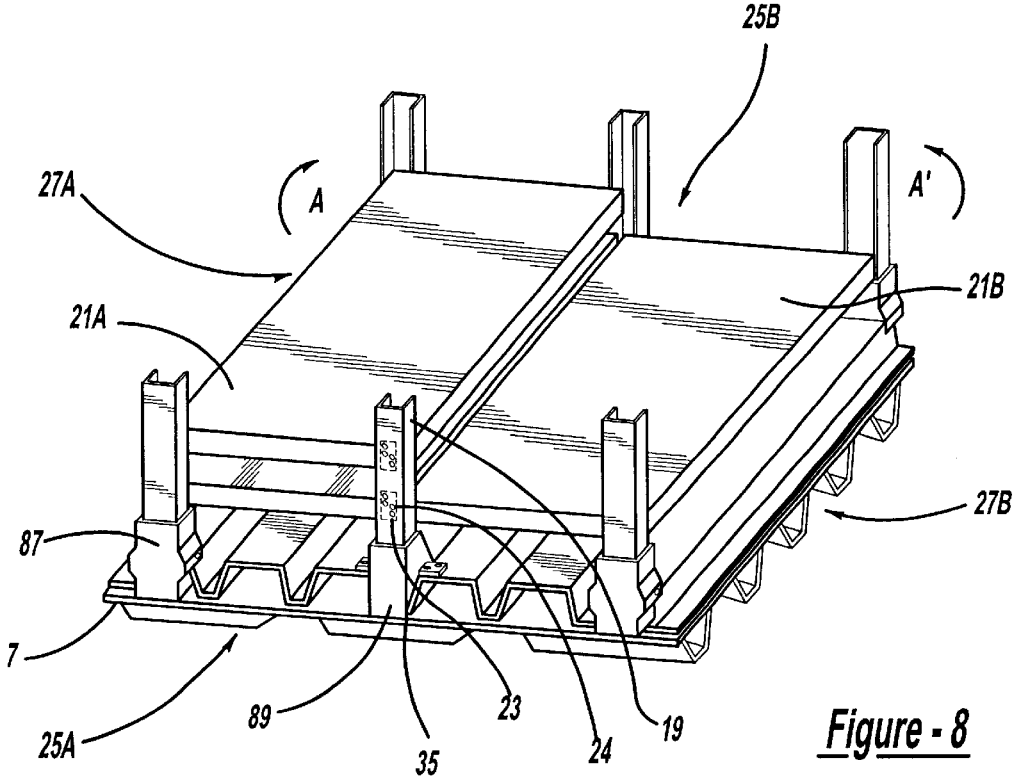
FIG. 8 is a perspective view of one embodiment of the present invention.

The flexible parts transporting system 3 is realized when the universal shelf supports 23, mounted on uprights 19, are operably coupled to shelf assemblies 21. Shelf assemblies 21 are joined to the supports 23 by offset pivot hinges 35 which are coupled to bolts 24. The universal shelf supports 23 allow the shelf assemblies 21 to swing open at an angle relative to the rigid rack frame 7. In a first embodiment of the present invention show in FIG. 8, the base has been formed with two short sides 25A and 25B and two long sides 27A and 27B. Brackets 89 are located in the center of the two short sides 25 and brackets 87 are located at each corner of the rigid rack frame 7. Uprights 19 having equal vertical dimensions are coupled to brackets 87 and 89. Universal shelf supports 23 are mounted to the uprights 19 coupled to brackets 89. Shelf assemblies 21 are then operably coupled to the universal shelf supports 23. This configuration produces twin shelf assemblies 21A and 21B that swing open widthwise in opposite directions A and A'. This twin shelf configuration is then repeated with consecutive twin shelf assemblies placed on top of each other until the desired or absolute number of shelf assemblies is reached. Since the universal shelf supports 23 can be coupled to any upright 19 there are numerous shelving configurations which can be created.

Figure 9:
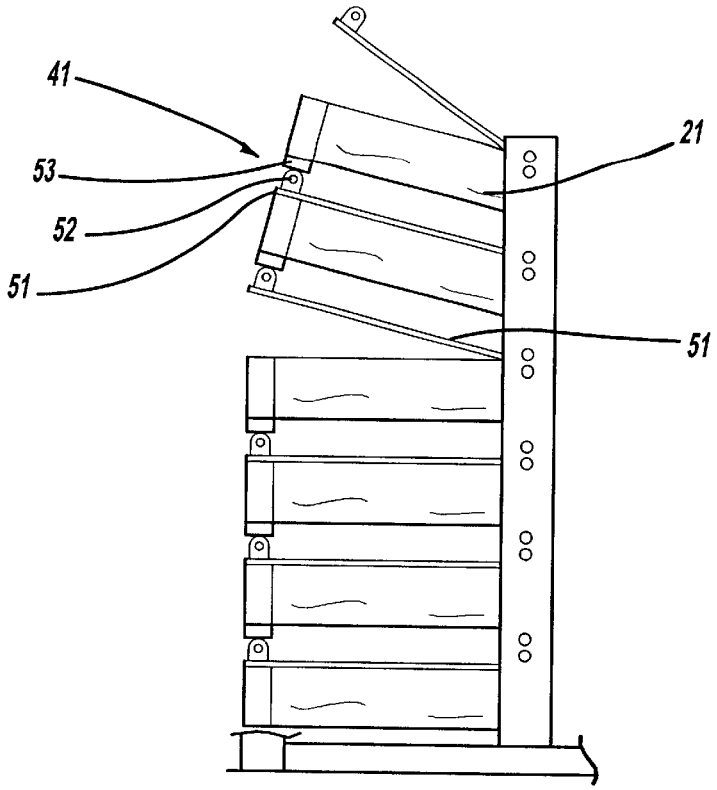
FIG. 9 is a side elevation view of one embodiment of the present invention demonstrating the shelf assembly sequencing.

The sequencing advantage of this invention is provided by the interaction of the shelf assemblies 21 and the lid and strut assemblies 41 as shown in FIG. 9. The lid attachment point 52 attaches to the lid 51 and shelf assembly 21 above it using linkage 53. In one embodiment of the present invention linkage 53 comprises a mechanical connection or chord. As each shelf assembly 21 is emptied, it is lifted and this action will lift the lid 51 below, exposing the next layer of parts to be removed. Loading is the reverse process, starting with all shelf assemblies 21 open and loading from the bottom. As each shelf assembly 21 is loaded, its lid 51 is closed and this action will open the shelf assembly 21 directly above the lid 51. This sequencing greatly decreases the time needed to load and unload parts because it reduces two actions, moving the shelf assembly and moving the lid, into a single action.

Figure 10:
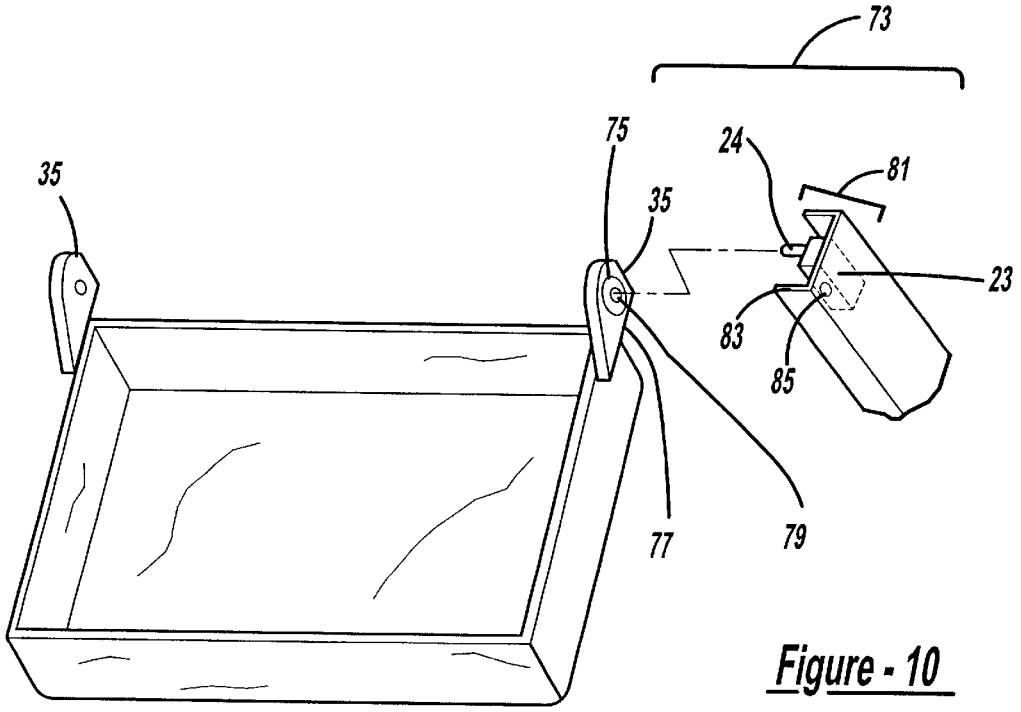
FIG. 10 is a view of one embodiment of the lid positioning device.

The lid and strut assemblies 41 and shelf assemblies 21 can be locked open, closed or in an intermediate position with a lid positioning device 73. FIG. 10 is a view of one embodiment of the lid positioning device 73 used to hold the lid 51 and shelf assemblies 21 open or closed. The offset pivot hinge 35 is operably coupled to the lid positioning device 73. The lid positioning device 73 includes a rod assembly 81 and a cam 75 whose edges define a first indentation 77 and a second indentation 79. The rod assembly 81 is coupled to the universal shelf support 23 and is composed of a rod 83 and spring 85 applying a force to the rod 83. When the offset pivot hinge 35 rotates, the cam 75 will rotate and the spring 85 will force the rod 83 along the edge of the cam 75 until the rod 83 engages the first indentation 77 or the second indentation 79. If the rod 83 engages the first indentation 77, the lid 51 will be locked open, whereas if the rod 83 engages the second indention 79, the lid 51 will be locked closed.

Figure 11A:
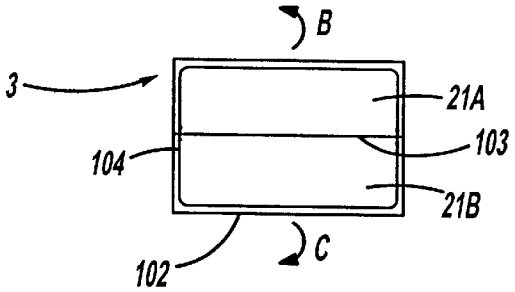
FIG. 11A–11F illustrates permutations of shelving configurations for the present invention.

FIG. 11A illustrates a flexible parts transporting system 3 with a longer latitudinal side 102 and a shorter longitudinal side 104. Shelf assemblies 21A and 21B are of equal size and bisect side 104, dividing the flexible parts transporting system 3 into two equal sections and forming hinge line 103. Sequential shelf assemblies 21 are stacked underneath shelf assemblies 21A and 21B and are configured in the same manner. A person of ordinary skill in the art would recognize that the shelf assemblies 21A and 21 B may be of differing dimensions and may divide the flexible parts transporting system 3 into unequal sections shifting the hinge line 103. The shelf assemblies 21A and 21B are configured to swing open about the hinge line 103 in a longitudinal direction with respect to the flexible parts transporting system 3 and in opposite directions with respect to each other as indicated by arrows B and C.

Figure 11B:
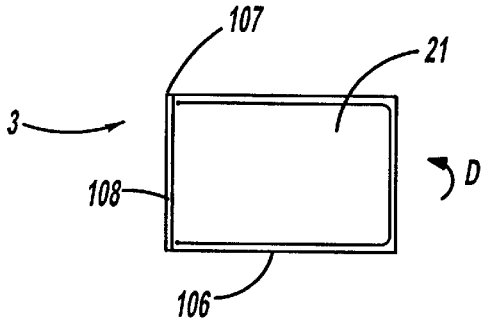

FIG. 11B illustrates a flexible parts transporting system 3 with a longer latitudinal side 106 and a shorter longitudinal side 108. Shelf assembly 21 is the lone shelf assembly visible in this plan view, but sequential shelf assemblies 21 configured in the same manner are stacked underneath the visible shelf assembly 21. The shelf assembly 21 is configured to swing open about hinge line 107 and in a latitudinal direction with respect to the flexible parts transporting system 3 indicated by arrow D.

Figure 11C:
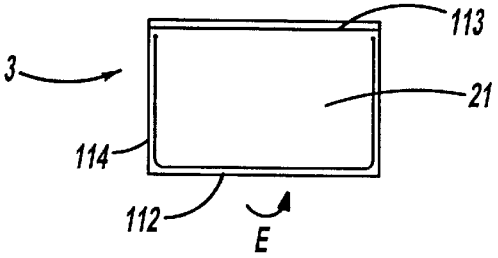

FIG. 11C illustrates a flexible parts transporting system 3 with a longer latitudinal side 112 and a shorter longitudinal side 114. Shelf assembly 21 is the lone shelf assembly visible in this plan view, but sequential shelf assemblies 21 configured in the same manner are stacked underneath the visible shelf assembly 21. The shelf assembly 21 is configured to swing open about hinge line 113 and in a longitudinal direction with respect to the flexible parts transporting system 3 indicated by arrow E.

Figure 11D:
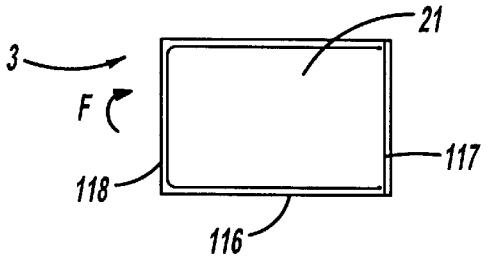

FIG. 11D illustrates a flexible parts transporting system 3 with a longer latitudinal side 116 and a shorter longitudinal side 118. Shelf assembly 21 is the lone shelf assembly visible in this plan view, but sequential shelf assemblies 21 configured in the same manner are stacked underneath the visible shelf assembly 21. The shelf assembly 21 is configured to swing open about hinge line 117 and in a latitudinal direction with respect to the flexible parts transporting system 3 indicated by arrow F.

Figure 11E:
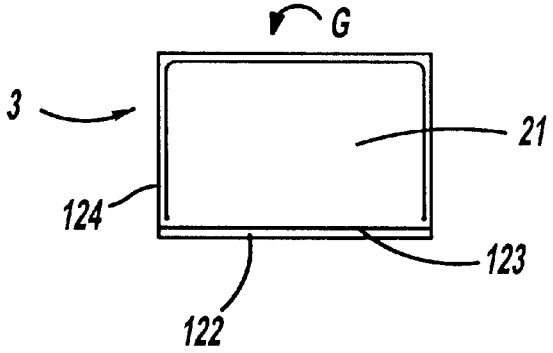

FIG. 11E illustrates a flexible parts transporting system 3 with a longer latitudinal side 122 and a shorter longitudinal side 124. Shelf assembly 21 is the lone shelf assembly visible in this plan view, but sequential shelf assemblies 21 configured in the same manner are stacked underneath the visible shelf assembly 21. The shelf assembly 21 is configured to swing open about hinge line 123 and in a longitudinal direction with respect to the flexible parts transporting system 3 indicated by arrow G.

Figure 11F:
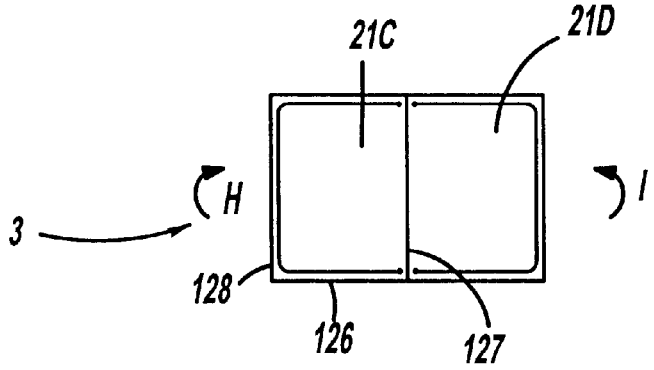

FIG. 11F illustrates a flexible parts transporting system 3 with a longer latitudinal side 126 and a shorter longitudinal side 128. Shelf assemblies 21C and 21D are of equal size and bisect side 126, dividing the flexible parts transporting system 3 into two equal sections and forming hinge line 127. Sequential shelf assemblies 21 are stacked underneath shelf assemblies 21C and 21D and are configured in the same manner. A person of ordinary skill in the art would recognize that the shelf assemblies 21C and 21D may be of differing dimensions and may divide the flexible parts transporting system 3 into unequal sections shifting the hinge line 127. The shelf assemblies 21C and 21D are configured to swing open about hinge line 127, in a latitudinal direction with respect to the flexible parts transporting system 3, and in opposite directions with respect to each other as indicated by arrows H and I.

It is to be understood that the invention is not limited to the exact construction illustrated and described above, but that various changes and modifications may be made without departing from the spirit and scope of the invention as defined in the following claims.

What is claimed is:

1. A parts transporting system comprising:

a frame;

at least one pair of uprights coupled to the frame;

at least two shelf assemblies positioned one above the other, each pivotally coupled to a first pair of said at least one pair of uprights, each shelf assembly including a shelf frame, a sling assembly coupled to the shelf frame forming at least one compartment for parts storage, a lid pivotally connected to each said shelf frame wherein each said shelf frame is positioned directly above one lid except a top lid, and a linkage secured to said lid and to said shelf assembly above the lid connecting said lid to said shelf assembly.

2. The parts transporting system of claim 1 wherein the frame further includes receptacles to receive and secure casters.

3. The parts transporting system of claim 1 wherein the frame further includes recesses to receive prongs for lifting and carrying said frame.

4. The parts transporting system of claim 1 wherein the frame and the at least one pair of uprights are composed of a formable material.

5. The parts transporting system of claim 1 wherein an additional plurality of shelf assemblies is coupled to said first pair of uprights.

6. The parts transporting system of claim 1 wherein the sling assembly is mechanically attached to the shelf frame.

7. The parts transporting system of claim 1 wherein the sling assembly provides means for varying shape and size of the compartments.

8. The parts transporting system of claim 1 wherein at least one compartment of the sling assembly includes a valve thereby allowing residue to be flushed from the compartment.

9. The parts transporting system of claim 1 wherein at least one compartment is equipped with an interior dunnage, whereby the interior dunnage further secures and protects parts contained within the compartment.

10. The parts transporting system of claim 1 wherein the sling assembly is attached to the shelf frame by a mechanical fastener whereby the mechanical fastener allows removal of the sling assembly.

11. The parts transporting system of claim 1 wherein the sling assembly is equipped with an aperture thereby allowing visual inspection of components in the sling assembly.

12. The parts transporting system of claim 1 wherein the sling assembly includes a transparent window thereby allowing visual inspection of components in the sling assembly.

13. The parts transporting system of claim 1 wherein the sling assembly includes sliding supports to vary the shape and size of the compartments.

14. The parts transporting system of claim 1 wherein at least one compartment of the sling assembly includes an opening thereby allowing residue to be flushed from the compartment.

15. The parts transporting system of claim 1 wherein the sling assembly is chemically attached to the shelf frame.

16. A parts transporting system comprising:

a frame;

at least one pair of uprights coupled to the frame;

a plurality of pairs of shelf supports coupled to a first opposing pair of the at least one pair of uprights;

at least two shelf assemblies positioned one above the other, each pivotally coupled to a corresponding opposing pair of said shelf supports; each shelf assembly including a shelf frame forming at least one compartment for parts storage, and positioning means for releasably locking the shelf assembly into a lowered first position and into a raised second position wherein the positioning means comprises at least one cam having a first indentation and a second indentation and the at least one cam being coupled to each said shelf assembly;

at least one reciprocable rod supported by one of said shelf supports biased in an extended position for selectively engaging the first or the second indentation of the cam when said shelf assembly is rotated between said first and second position, and tending to restrict rotation of said cam when in said extended position.

17. A parts transporting system comprising:

a planar base;

a plurality of uprights coupled to said base;

at least two shelf assemblies pivotally supported between said plurality of uprights in a first position substantially parallel to said base and a second open position at an angle relative to said base, each shelf assembly including a shelf frame forming at least one compartment for parts storage;

a lid pivotally coupled to each of the shelf frames wherein each shelf frame is positioned directly above a corresponding lid except the lid corresponding to the upper most shelf frame; and a linkage coupled to said corresponding lid and to said shelf assembly above said corresponding lid.

18. The parts transporting system of claim 17 wherein at least one compartment is equipped with an interior mesh, whereby the interior mesh further secures and protects parts contained within the compartment.

19. A parts transporting system comprising:

a plurality of shelf assemblies;

a support means for suspending said plurality of shelf assemblies;

a plurality of hinges which operably couple the shelf assemblies and the support means thereby allowing the shelf assemblies to swing about the hinges;

a lid coupled to each of the shelf assemblies;

a means for positioning the lid in selected positions;

a means for creating variable sized compartments in the shelves to hold parts; and a means to sequence the shelf assemblies during loading and unloading.

20. A stackable storage container system comprising:

a rigid generally planar bottom, at least one pair of rigid uprights, a plurality of pairs of shelf supports wherein each pair comprises a first shelf support member supported on a first upright of said at least one pair of uprights and a second shelf support member supported on a second upright of said at least one pair of uprights, each said pair of shelf supports defining a pivot axis;

a plurality of shelf members each having a compartment and a shelf frame defining a top of said compartment, said shelf members disposed between one pair of said plurality of shelf supports and pivotable about said pivot axis and disposed in vertical relation to each other, said shelf members further comprising a lid attached by at least one hinge to said shelf frame, said lid pivotable between a closed position covering said shelf member and an open position; and at least one linkage member operably connecting a first of said shelf frames and the lid of a proximate shelf frame such that said lid of said proximate shelf frame opens when said first of said shelf frames is pivoted into an upward orientation defining said open position.

* * * * *

UNITED STATES PATENT AND TRADEMARK OFFICE

CERTIFICATE OF CORRECTION

PATENT NO. : 6,220,462 B1
DATED : June 26, 2001
INVENTOR(S) : Bruce F. Brockman and Joseph P. Wieczorek It is certified that error appears in the above-identified patent and that said Letters Patent is hereby corrected as shown below:

Column 3,
Line 51, delete "sides" and insert -- side --
Line 62, delete "IT" and insert -- it --

Column 4,
Line 61, delete "show" and insert -- shown --

Signed and Sealed this

Eighth Day of January, 2002

*Attest:*

*Attesting Officer*

JAMES E. ROGAN
*Director of the United States Patent and Trademark Office*